US005577889A

United States Patent [19]

Terazaki et al.

[11] Patent Number: 5,577,889

[45] Date of Patent: Nov. 26, 1996

[54] GAS TURBINE COOLING BLADE

[75] Inventors: Masao Terazaki; Keizo Tsukagoshi, both of Takasago, Japan

[73] Assignee: Mitsubishi Jukogyo Kabushiki Kaisha, Tokyo, Japan

[21] Appl. No.: 420,784

[22] Filed: Apr. 12, 1995

[30] Foreign Application Priority Data

Apr. 14, 1994 [JP] Japan ..... 6-75729

[51] Int. Cl.[6] ..... F01D 5/18

[52] U.S. Cl. ..... 416/97 R; 415/115; 415/121.2

[58] Field of Search ..... 415/115, 121.2; 416/97 R, 96 A

[56] References Cited

U.S. PATENT DOCUMENTS 4,153,386 5/1979 Leogrande et al. ..... 415/115

FOREIGN PATENT DOCUMENTS 0375175 6/1990 European Pat. Off. .
0501813 9/1992 European Pat. Off. .
0615055 9/1994 European Pat. Off. .
55-114899 9/1980 Japan ..... 416/97 R
61-142399 6/1986 Japan ..... 415/121.2
61-241405 10/1986 Japan ..... 415/115
6-2700 1/1994 Japan ..... 415/121.2
1418624 12/1975 United Kingdom ..... 416/97 R
2216645 10/1989 United Kingdom .
2262314 6/1993 United Kingdom .

*Primary Examiner*—James Larson
*Attorney, Agent, or Firm*—Wenderoth, Lind & Ponack

[57] ABSTRACT

A gas turbine cooling blade maintains a cooling effect and prevents sticking of deposits to the belly surface of the blade. The blade is provided with a relatively big cooling hole formed on the belly part of a hollow stator blade at an acute angle with the blade surface for blowing out cooling air. A relatively small cooling hole is disposed downstream of the big hole at a more acute angle with the blade surface to bring a jet of cooling air along the blade surface.

9 Claims, 3 Drawing Sheets

GAS TURBINE COOLING BLADE

BACKGROUND OF THE INVENTION

The present invention relates to a gas turbine cooling blade capable of blowing deposits away and carrying out effective cooling operations.

FIG. 4 is a sectional view showing the cooling structure of a conventional gas turbine hollow stator blade. A hollow stator blade 11 is formed integrally with inside and outside shrouds (not shown in the Figure) by means of precision molding. Within the hollow stator blade 11 is installed an insert 13 having a plurality of cooling holes 12, and cooling air flows into it from the outside shroud. As shown by the arrows in the Figure, the cooling air flows out of the hole of the insert 13 and is brought into collision with the inner wall of the hollow stator blade 11 where impingement cooling is carried out, and the cooling air thus flows into a hollow chamber A formed between the insert 13 and the hollow stator blade 11.

The stator blade is then cooled while the cooling air flows toward the rear edge of the blade. A part of the cooling air flows out of a film cooling hole 14 along the blade profile and thereby the blade surface is film-cooled. The blade rear edge, including a pinfin 16, is convection-cooled by the cooling air flowing out of a slit 15 therein. Further, on a blade front edge thus is exposed most to high-temperature gas, a blade front edge part film cooling hole 18, called a shower head, is provided.

When the gas turbine cooling blade of this conventional type is used while burning heavy oil, etc., as described below, deposits 17 get stuck to a blade belly part where the flow speed is relatively slow, clogging the film cooling hole 14. These deposits are oxides made of such corrosive components as S(sulfur), Na(sodium) and the like included in fuels and Ca(calcium), Fe(iron), Si(silicon) and others included in intake air. They become solidified and stuck to the cooled blade surface when they are brought into contact therewith, though they are melted in an area of high-temperature gas at the front stage of the gas turbine, and they tend to stick more to the blade belly part where the flow speed is relatively slow.

In the case where the gas turbine cooling blade having the cooling structure described above is used for a gas turbine operated by burning, for example, crude oil and heavy oil other than such standard fuels as kerosene, gas oil, naphtha and the like, because many ashes and residual carbons are contained in heavy oil, deposits accumulate on the belly side of the turbine blade, and thereby the cooling performance of the air-cooling blade is greatly reduced within a short period of time. Consequently, high-temperature corrosion is generated.

SUMMARY OF THE INVENTION

The present invention was made in order to solve the problems described above.

A gas turbine cooling blade according to the present invention is provided with a relatively big cooling hole formed at an acute angle with the belly side surface of the blade for jetting a jet of cooling air and a relatively small cooling hole provided downstream of the big cooling hole so as to bring a jet of cooling air along the blade surface. The small cooling hole is formed at a more acute angle with the blade surface for jetting the jet of cooling air.

Produced deposits easily become solidified and stuck to the downstream side surface of a film cooling hole as they are brought into contact with a film layer formed on the boundary layer of the blade surface. Thus, according to the present invention, the relatively big cooling hole in the blade surface is provided upstream of the relatively small cooling hole, the small cooling hole being provided for blowing out a jet of cooling air that is specialized in carrying out a cooling operation along the blade surface. By means of the jet of cooling air from the relatively big cooling hole penetrating the boundary layer formed on the blade surface, produced deposits are blown off just before sticking, and thus sticking of the deposits to the blade surface is prevented. Also, from the relatively small downstream side cooling hole a jet of cooling air is blown out along the blade surface that supplements a cooling effect of the jet of cooling air from the relatively big upstream side cooling hole. By using both of these holes, the sticking of deposits to the blade surface is prevented, and thus film-cooling can be sufficiently performed.

DESCRIPTION OF THE PREFERRED EMBODIMENT

One embodiment according to the present invention will be described in detail with reference to the accompanying drawings.

Figure 1:
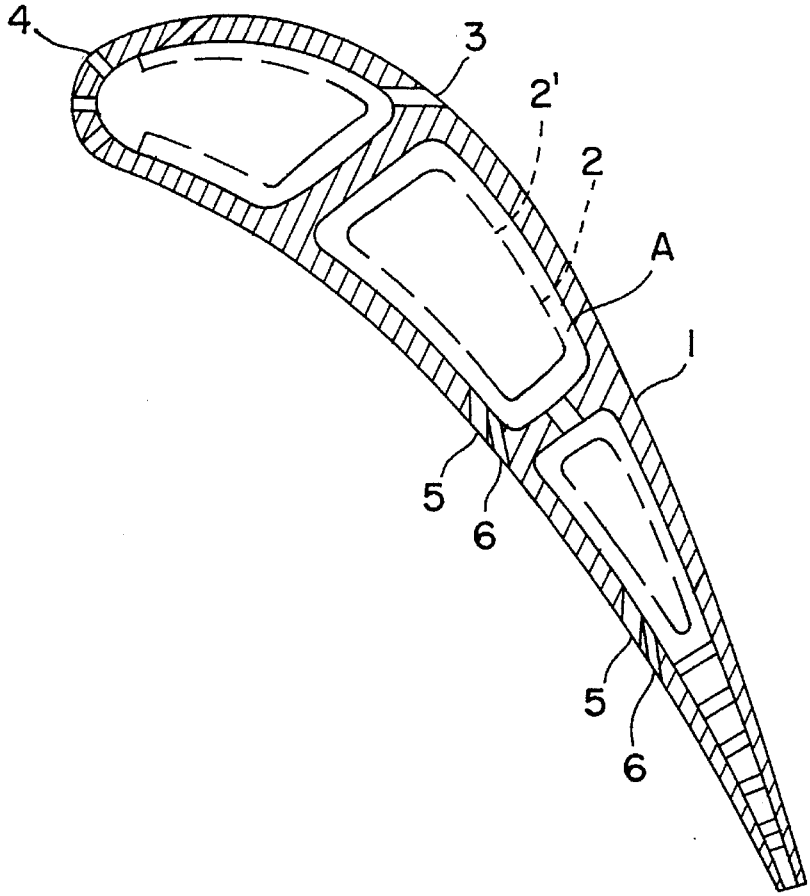
FIG. 1 is a sectional view showing one embodiment according to the present invention.
Figure 2:
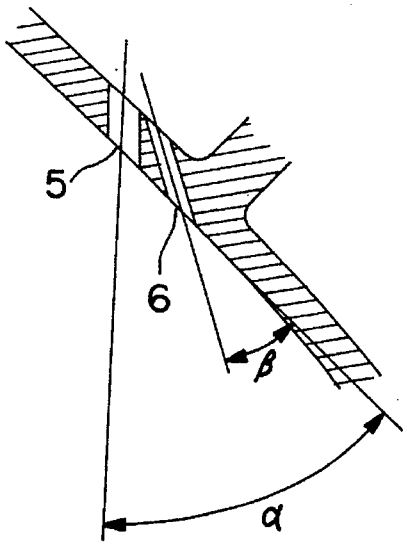
FIG. 2 is an enlarged view showing a part of the above embodiment wherein cooling holes are provided.

As shown in FIGS. 1 and 2, the cooling stator blade 1 of a gas turbine is provided with an insert 2 having a plurality of cooling holes 2' for impingement cooling on the inside of the stator blade 1. A hole 3 is for film-cooling, with the object of reinforcing a cooling operation, while a blade front edge part film cooling hole 4 (shower head) is provided on the front edge part of the blade.

On the belly part of the blade, a relatively big cooling hole 5 is at an acute angle with the blade surface and inclined toward the blade rear edge. A relatively small cooling hole 6 is at a more acute angle with the blade surface downstream (blade rear edge side) of the hole 5. Both holes are inclined toward the blade rear edge and arranged so as to bring the direction of the blown-off jet of cooling air along the blade surface, and are provided in combination.

Figure 4:
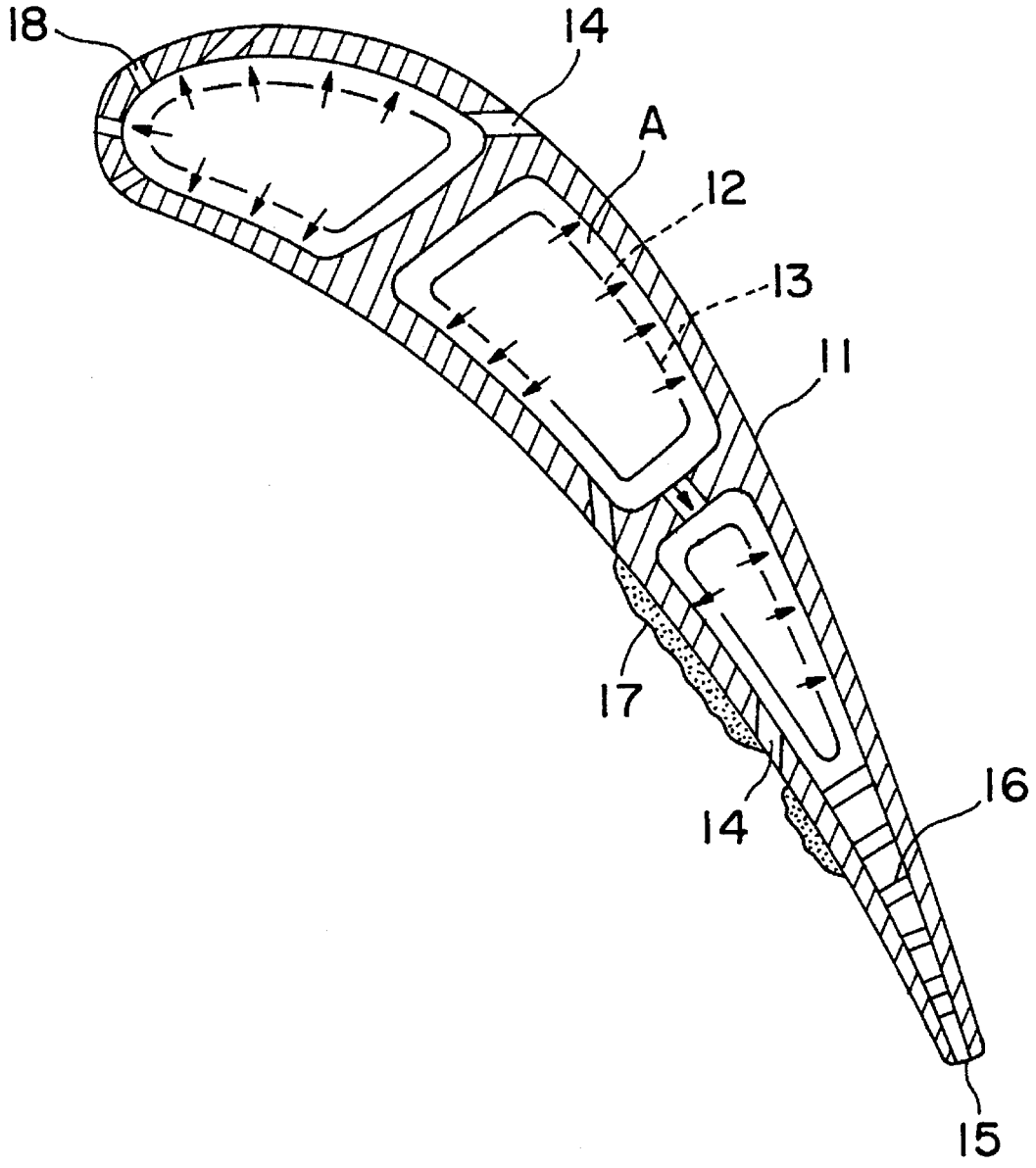
FIG. 4 (PRIOR ART)
FIG. 4 is a sectional view showing a cooling structure of a hollow stator blade of a conventional gas turbine.

Similar to the chamber A shown in FIG. 4, a hollow chamber A is formed between the insert 2 and the cooling stator blade 1. Cooling air flows from an outside shroud (not shown in the Figure) into the insert 2 and is blown out from a slit on the blade rear edge.

According to this embodiment, a large amount of air to film-cool the blade surface is jetted out from the relatively big cooling hole 5 formed on the blade belly part, and thereby deposits, just before sticking to the belly surface of the blade, can be blown off. From the relatively small cooling hole 6 disposed downstream of the big cooling hole 5, cooling air is jetted off along the blade surface in order to supplement the cooling effect of the air jetted out of the hole 5. By the air blown off from both of these holes 5 and 6, a film cooling effect can be maintained, deposits apt to accumulate on the belly surface of the blade can be blown off, and thus their sticking to the blade can be prevented.

Further, the relatively big cooling hole 5 must be formed to have an ejection angle α within the range of ≧45° to ≦90° so that the ejected air penetrates a boundary layer formed along the blade surface. In this way deposits, just before sticking to the blade surface, can be blown off by the air entering the boundary layer with a low flow speed, and thus it becomes difficult for deposits to stick to the blade surface.

On the other hand, the relatively small cooling hole 6 provided downstream of the relatively big cooling hole 5 (better if provived immediately thereafter) must be formed having an ejection angle β within the range of ≧20° to ≦40° and preferably 30°, so as to make the film efficiency the highest. Thus, a film cooling film is formed along the blade surface.

Further, air pressure adjustment is carried out for the insert 2 provided within the blade, and a blowing rate (see below) is set around 1.0, where film efficiency is considered to be the highest.

$$\text{Blowing rate} = \frac{pv(\text{blowing})}{p'v'(\text{main flow})}$$

Herein, p,v are density and speed of blown air, respectively, while p', v' are density and speed of the main flow fluid.

In this way, an air film can be formed downstream of the relatively small cooling hole 6 without penetrating the boundary layer to be formed on the blade surface.

Figure 3A:
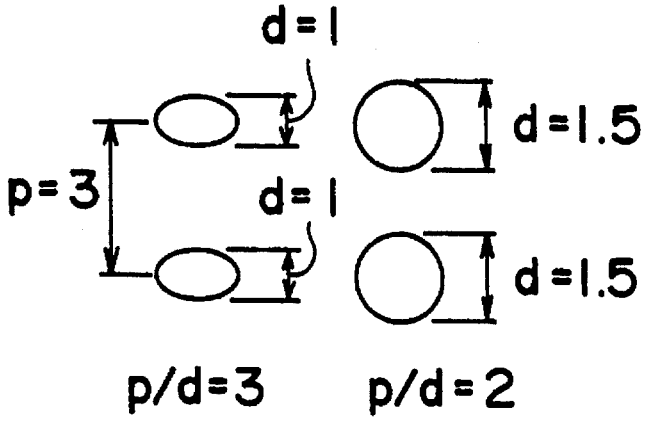
FIGS. 3A and 3B are views showing examples of arranging relatively large and small cooling holes.
Figure 3B:
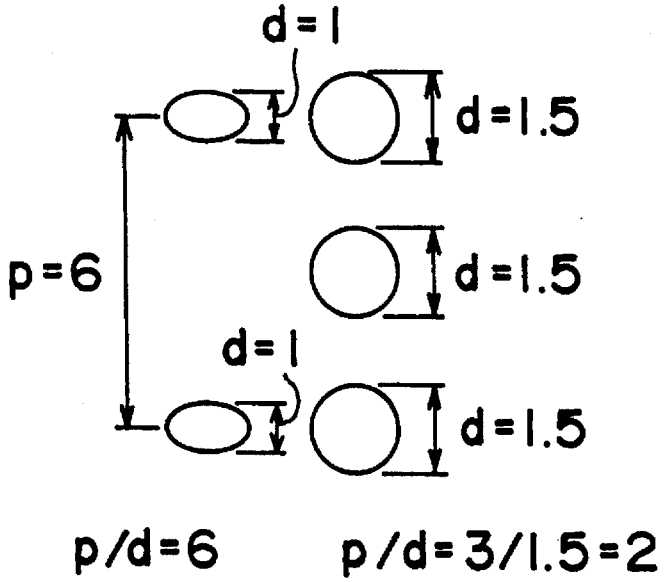

Furthermore, it is desirable that a pitch to diameter rate(p/d) of the relatively big cooling hole 5 and the relatively small cooling hole 6 is set within a range of 1 to 3. Note for example the arrangements of cooling holes and respective rate illustrated in FIGS. 3A and 3B.

The gas turbine cooling blade according to the present invention is not only useful for a gas turbine operated by burning crude oil and heavy oil, but also for ones operated by burning by-product gas produced at chemical plants, by-product liquid fuels and blast furnace gas, or for other types, including a gasified coal gas turbine, etc., which produce many deposits.

Further, it is useful in maintaining the film cooling effect without the sticking of deposits to the belly side of the blade by means of small and large diamter cooling holes therein having different angles to the blade surface as described.

As can be seen from the drawing figures, only the belly part of the blade has both the first cooling holes and the second cooling holes provided thereon. As can be further seen from the drawings, the first cooling hole and the second cooling hole communicate with the hollow interior through respective first and second inlets that are spaced from each other along an interior surface of the blade.

Thus, the gas turbine cooling blade according to the present invention is capable of solving such problems as a reduction in the cooling performance of a cooling blade of a gas turbine operated by burning a heavy oil, etc. within a short period of time and the generation of high-temperature corrosion due to such burning and is extremely effective in the improvement and maintenance of the reliability of the gas turbine.

What is claimed is:

1. A gas turbine blade, comprising:

a blade having a blade surface, a hollow interior, an upstream side, a downstream side and a belly part;

a first cooling hole in said hollow blade located at said belly part communicating said hollow interior with said blade surface and extending at a first acute angle with said blade surface for blowing cooling air out of said hollow interior; and a second cooling hole in said hollow blade that is smaller than said first cooling hole, located at said belly part downstream of said first cooling hole, communicates said hollow interior with said blade surface and extends at a second acute angle with said blade surface, said second acute angle being more acute than said first acute angle, for blowing cooling air out of said hollow interior along said blade surface;

wherein only said belly part of said blade is provided with both said first cooling hole and said second cooling and; and wherein said first cooling hole and said second cooling hole communicate with said hollow interior through respective first and second inlets that are spaced from each other along an interior surface of said blade that defines said hollow interior.

2. The gas turbine blade of claim 1, wherein said first acute angle of said first cooling hole is a first air ejection angle and is at least 45 degrees and at most 90 degrees.

3. The gas turbine blade of claim 2, wherein said second acute angle of said second cooling hole is a second air ejection angle and is at least 25 degrees and at most 40 degrees.

4. The gas turbine blade of claim 1, wherein said second acute angle of said second cooling hole is an air ejection angle and is at least 25 degrees and at most 40 degrees.

5. The gas turbine blade of claim 1, wherein said blade surface comprises a convex portion on one side thereof and a concave portion on an opposite side thereof, said concave portion comprising said belly part.

6. A gas turbine blade, comprising:

a blade having a blade surface, a hollow interior, an upstream side, a downstream side, and a belly part;

a first cooling hole in said hollow blade located at said belly part communicating said hollow interior with said blade surface and extending at a first acute angle with said blade surface for blowing cooling air out of said hollow interior; and a second cooling hole in said hollow blade that is smaller than said first cooling hole, located at said belly part downstream of said first cooling hole, communicates said hollow interior with said blade surface and extends at a second acute angle with said blade surface, said second acute angle being more acute than said first acute angle, for blowing cooling air out of said hollow interior along said blade surface wherein said blade comprises a plurality of said first cooling holes and a plurality of said second cooling holes, and a pitch to diameter rate of said first cooling holes is in a range of 1 to 3.

7. The gas turbine blade of claim 6, wherein a pitch to diameter rate of said second cooling holes is in a range of 1 to 3.

8. A gas turbine blade, comprising:

a blade having a blade surface, a hollow interior, an upstream side, a downstream side and a belly part;

a first cooling hole in said hollow blade located at said belly part communicating said hollow interior with said blade surface and extending at a first acute angle with said blade surface for blowing cooling air out of said hollow interior; and a second cooling hole in said hollow blade that is smaller than said first cooling hole, located at said belly part downstream of said first cooling hole, communicates said hollow interior with said blade surface and extends at a second acute angle with said blade surface, said second acute angle being more acute than said first acute angle, for blowing cooling air out of said hollow interior along said blade surface wherein said blade comprises a plurality of said second cooling holes, and a pitch to diameter rate of said second cooling holes is in a range of 1 to 3.

9. A gas turbine blade, comprising:

a blade having a blade surface, a hollow interior, an upstream side, a downstream side and a concave portion;

a first cooling hole in said hollow blade located at said concave portion communicating said hollow interior with said blade surface and extending at a first acute angle with said blade surface for blowing cooling air out of said hollow interior; and a second cooling hole in said hollow blade that is smaller than said first cooling hole, located at said concave portion downstream of said first cooling hole, communicates said hollow interior with said blade surface and extends at a second acute angle with said blade surface, said second acute angle being more acute than said first acute angle, for blowing cooling air out of said hollow interior along said blade surface;

wherein only said concave portion is provided with both said first cooling hole and said second cooling hole; and wherein said first cooling hole and said second cooling hole communicate with said hollow interior through respective first and second inlets that are spaced from each other along an interior surface of said blade that defines said hollow interior.

* * * * *